US006742910B2

(12) United States Patent
Chen

(10) Patent No.: US 6,742,910 B2
(45) Date of Patent: Jun. 1, 2004

(54) LED FLASHLIGHT WITH REPLACEABLE LED

(76) Inventor: Yueh Fu Chen, No.12, Lane.223, Sec.2, Yuan Hwan N. Road, Feng Yuan Taichung Hsien (TW)

( * ) Notice: Subject to any disclaimer, the term of this patent is extended or adjusted under 35 U.S.C. 154(b) by 54 days.

(21) Appl. No.: 10/279,921

(22) Filed: Oct. 25, 2002

(65) Prior Publication Data

US 2004/0080934 A1 Apr. 29, 2004

(51) Int. Cl.[7] ..... F21L 4/04

(52) U.S. Cl. ..... 362/206; 362/184; 362/198; 362/202; 362/800

(58) Field of Search ..... 362/184, 198, 362/202–208, 800

(56) References Cited

U.S. PATENT DOCUMENTS 6,402,340 B1 * 6/2002 Sharrah et al. ..... 362/206
6,491,409 B1 * 12/2002 Sharrah et al. ..... 362/206
6,517,215 B2 * 2/2003 Mele ..... 362/203
RE38,014 E * 3/2003 Bieberstein ..... 362/206
6,536,912 B2 * 3/2003 Parker ..... 362/206

* cited by examiner

*Primary Examiner*—Stephen F. Husar
(74) *Attorney, Agent, or Firm*—Troxell Law Office PLLC

(57) ABSTRACT

LED flashlight with replaceable LED, including: a barrel body in which cells are installed; at least one LED light including a light seat having a conductive section disposed at rear end for electrically connecting with the cells and an LED disposed at front end for electrically connecting with the conductive section, the rear end of the light seat being detachably connected with front end of the barrel section; a switch seat disposed at rear end of the barrel body for electrically connecting with the cells. By means of operating the switch seat, the turning on/off of the LED is controllable. The LED light is replaceable with a new one. The flashlight further includes a flexible conductive connecting assembly one end of which is detachably connected with front end of the barrel body. The rear end of the LED light is detachably connected with the other end of the conductive connecting assembly.

20 Claims, 6 Drawing Sheets

LED FLASHLIGHT WITH REPLACEABLE LED

BACKGROUND OF THE INVENTION

The present invention is related to an illuminator, and more particularly to an LED flashlight with replaceable LED. The LED flashlight can be used in a narrow space.

Light emitting diodes (LED) are widely used in various fields such as flashlights. FIG. 1 shows a conventional LED flashlight 10. An LED 14 is fixed at front end of the barrel 12 of the flashlight 10. Cells are install in the barrel 12. A switch 16 is disposed at rear end of the barrel 12 for controlling turning on/off of the flashlight.

The above flashlight employs one single LED 14 as the light source and is mainly applicable to small range illumination.

Such flashlight has some shortcomings as follows:

First, the LED 14 is fixed on the barrel 12 of the flashlight and cannot be detached therefrom. When the using life of the LED ends, the entire flashlight must be discarded. Moreover, the LED is exposed to outer side and easy to be collided and damaged.

Second, the flashlight 10 can only emit single color of light. That is, the color of light provided by the flashlight is just the color of the light emitted by the LED 12. Accordingly, the flashlight cannot provide other color of light.

Third, the LED always emits light from the front end of the flashlight. Such flashlight is applicable only to open space. In a narrow space such as a fissure, the flashlight can be hardly extended into the narrow space to illuminate the same. Therefore, the use of the flashlight is limited.

SUMMARY OF THE INVENTION

It is therefore a primary object of the present invention to provide an LED flashlight in which the LED is replaceable without discarding other components of the flashlight so as to avoid waste of resource.

It is a further object of the present invention to provide the above LED flashlight which is applicable to wider range.

It is still a further object of the present invention to provide the above LED flashlight which can be used in a narrow space to provide illumination.

The present invention can be best understood through the following description and accompanying drawings wherein:

DETAILED DESCRIPTION OF THE PREFERRED EMBODIMENTS

Figure 1:
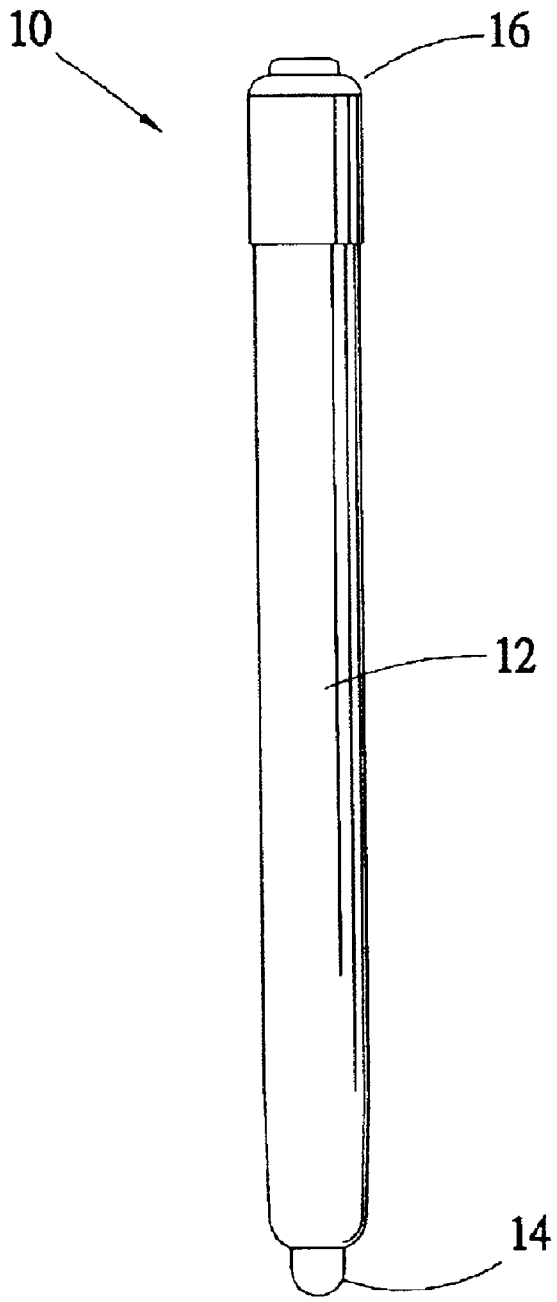
Fig. 1 PRIOR ART
FIG. 1 is a front view of a conventional LED flashlight.
Figure 2:
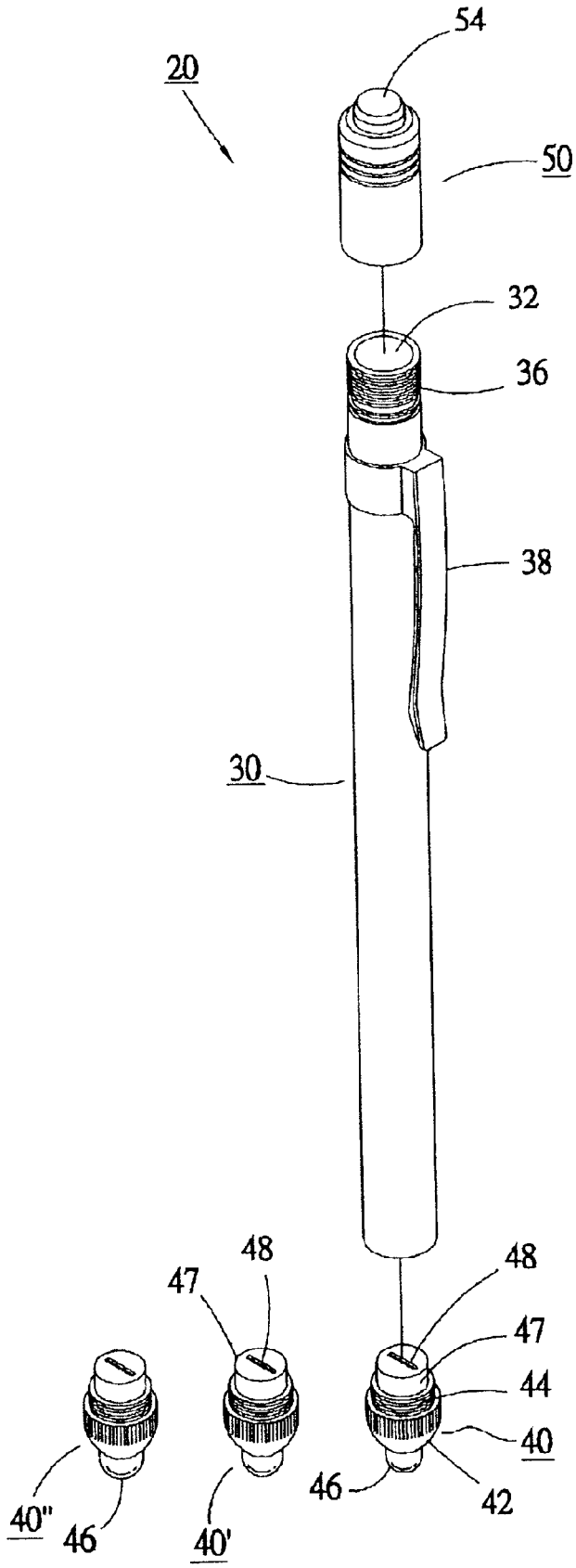
FIG. 2 is a perspective exploded view of a first embodiment of the present invention.
Figure 3:
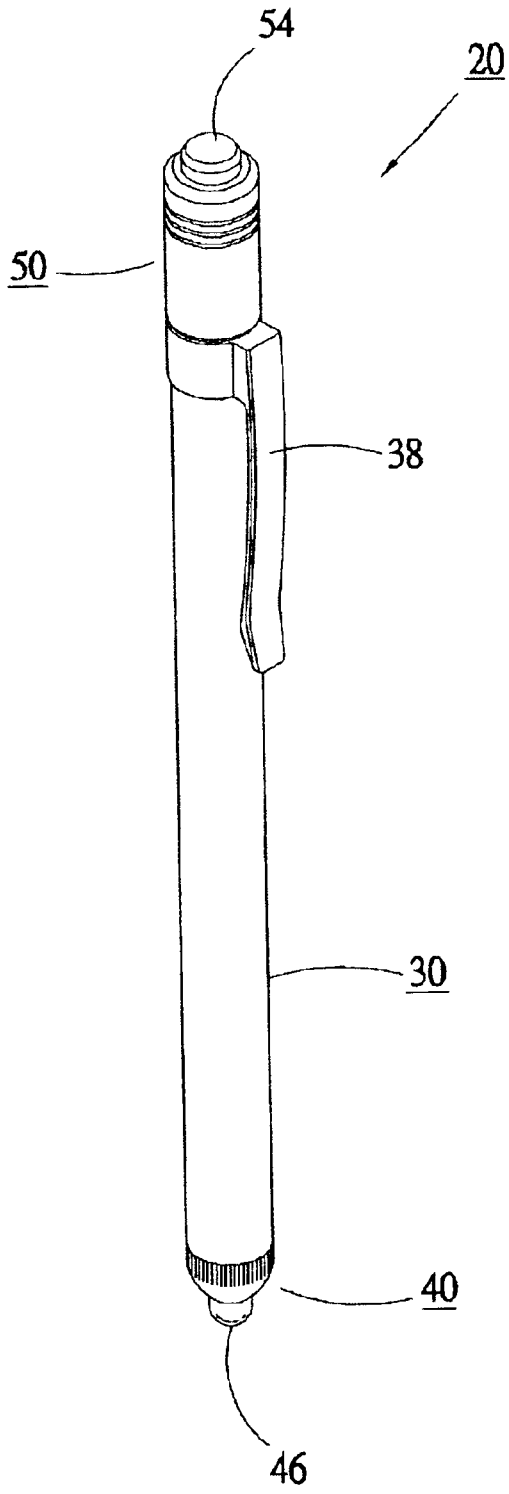
FIG. 3 is a perspective assembled view of the first embodiment of the present invention.

Please refer to FIGS. 2 and 3. According to a preferred embodiment, the LED flashlight 20 of the present invention includes a barrel body 30, a predetermined number of LED lights such as three lights 40, 40', 40" and a switch seat 50.

Figure 4:
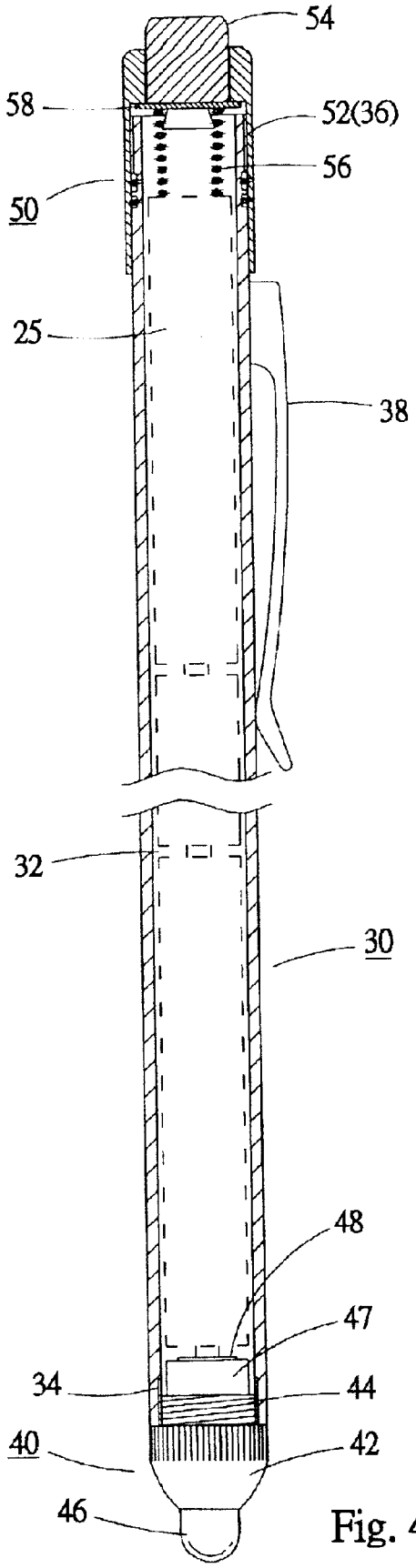
FIG. 4 is a longitudinal sectional view of the first embodiment of the present invention.

The barrel body 30 has an internal receiving space 32 axially passing through the barrel body 30. Referring to FIG. 4, a screwed section 34 which is a thread is formed on inner circumference of front end of the receiving space 32. A threaded section 36 is formed on outer circumference of the rear end of the barrel body 30. In addition, a clip member 38 is disposed on outer circumference of the barrel body 30 near the rear end thereof.

Each of the LED lights 40, 40', 40" has a light seat 42. The outer circumference of rear end of the light seat 42 is formed with a threaded section 44. An LED 46 is fixedly disposed in the light seat 42 and protrudes from front end thereof. A plastic boss section 47 is fixedly disposed at rear end of the light seat 42. A conductive section 48 is disposed in the boss section 47. The conductive section 48 is formed by a metal wire embedded in the boss section 47. An inner end of the metal wire is electrically connected with the LED 46 and inner wall of the light seat 42. An outer end of the metal wire is exposed to outer side of the end face of the boss section 47 to form the conductive section 48. The threaded section 44 of the light 40 is screwed with the screwed section 34 of front end of the barrel body 30 to detachably mount the light 40 at front end of the barrel body 30. In addition, in this embodiment, the LED 46 of the three lights 40, 40', 40" respectively emit different colors of light such as white light, blue light and violet light. The boss sections 47 of the lights are respectively white, blue and violet for identifying the colors of the light emitted by the respective lights.

The switch seat 50 is a hollow cylindrical body. The inner circumference of front end of the switch seat 50 is formed with a threaded section 52 as shown in FIG. 4. A press button 54 is fitted through rear end of the switch seat 50 for a user to press into the switch seat. A spring-like contact 56 is connected with inner end of the press button 54 and positioned in the switch seat. The threaded section 52 of the switch seat is screwed with the threaded section 36 of rear end of the barrel body 30 to detachably connect the switch seat with the barrel body. The switch seat pertains to prior art and will not be further described hereafter.

The three lights 40, 40', 40" emit different colors of light beams so that in use, a user can selectively mount a light with necessary color on the barrel body 30. Several cells 25 are loaded in the receiving space 32 of the barrel body as shown in FIG. 4. The positive electrode of the cell contacts with the conductive section 48 of the light 40. Then the switch seat 50 is screwed onto the barrel body to make the contact 56 of the switch seat 50 in contact with the negative electrode of the cell.

When illuminated, by means of turning the switch seat 50 or pressing the press button 54, the conductive plate 58 in the switch seat is contacted with the barrel body 30 to close the circuit and make the LED 46 emit light for illumination.

The switch seat 50 can be turned outward or the press button 54 can be released from the pressing force to open the circuit and turn off the LED.

By means of the clip member 38, the flashlight 20 can be fixed on the clothes and freely carried by a user.

Figure 5:
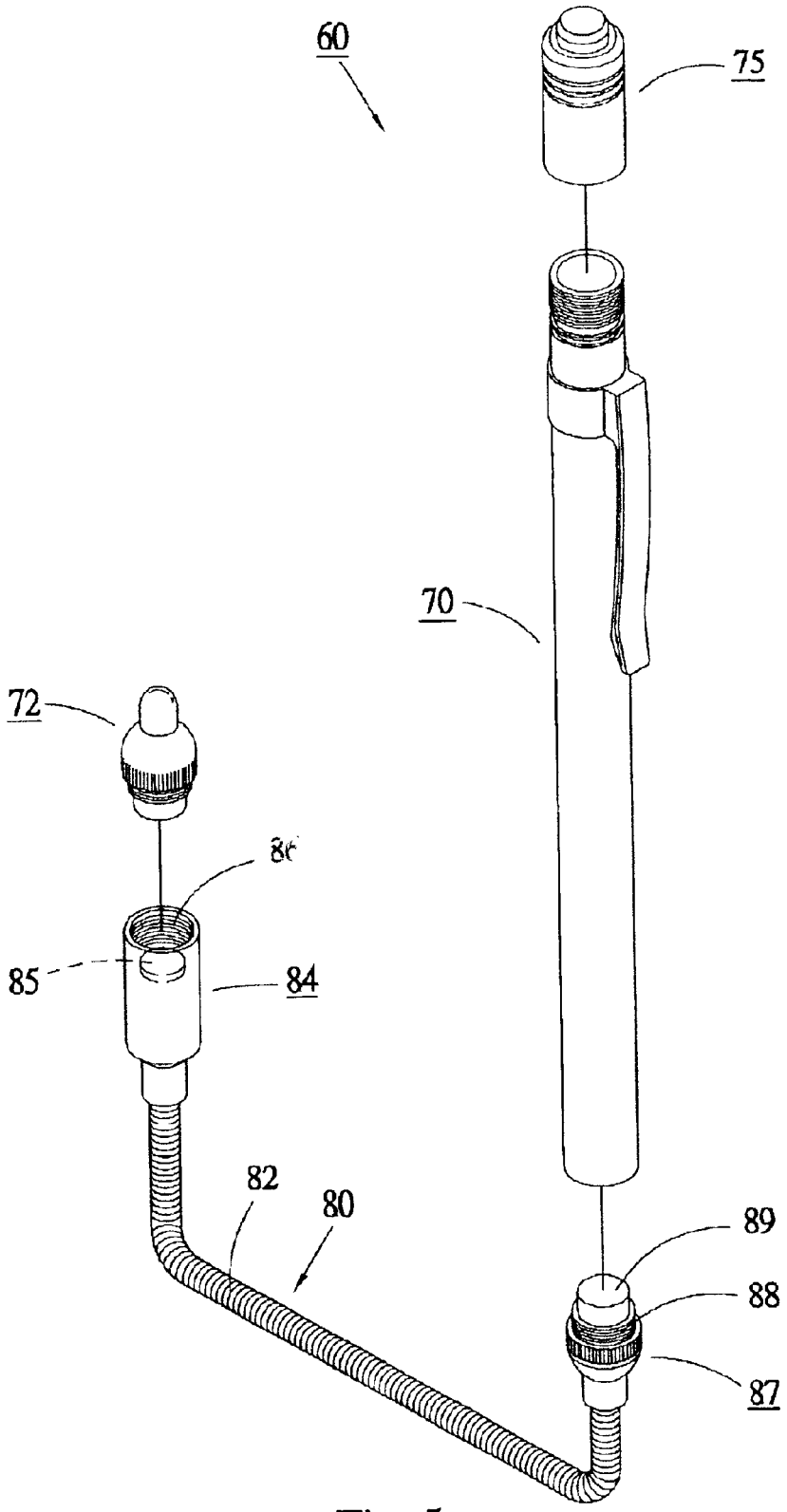
FIG. 5 is a perspective exploded view of a second embodiment of the present invention.
Figure 6:
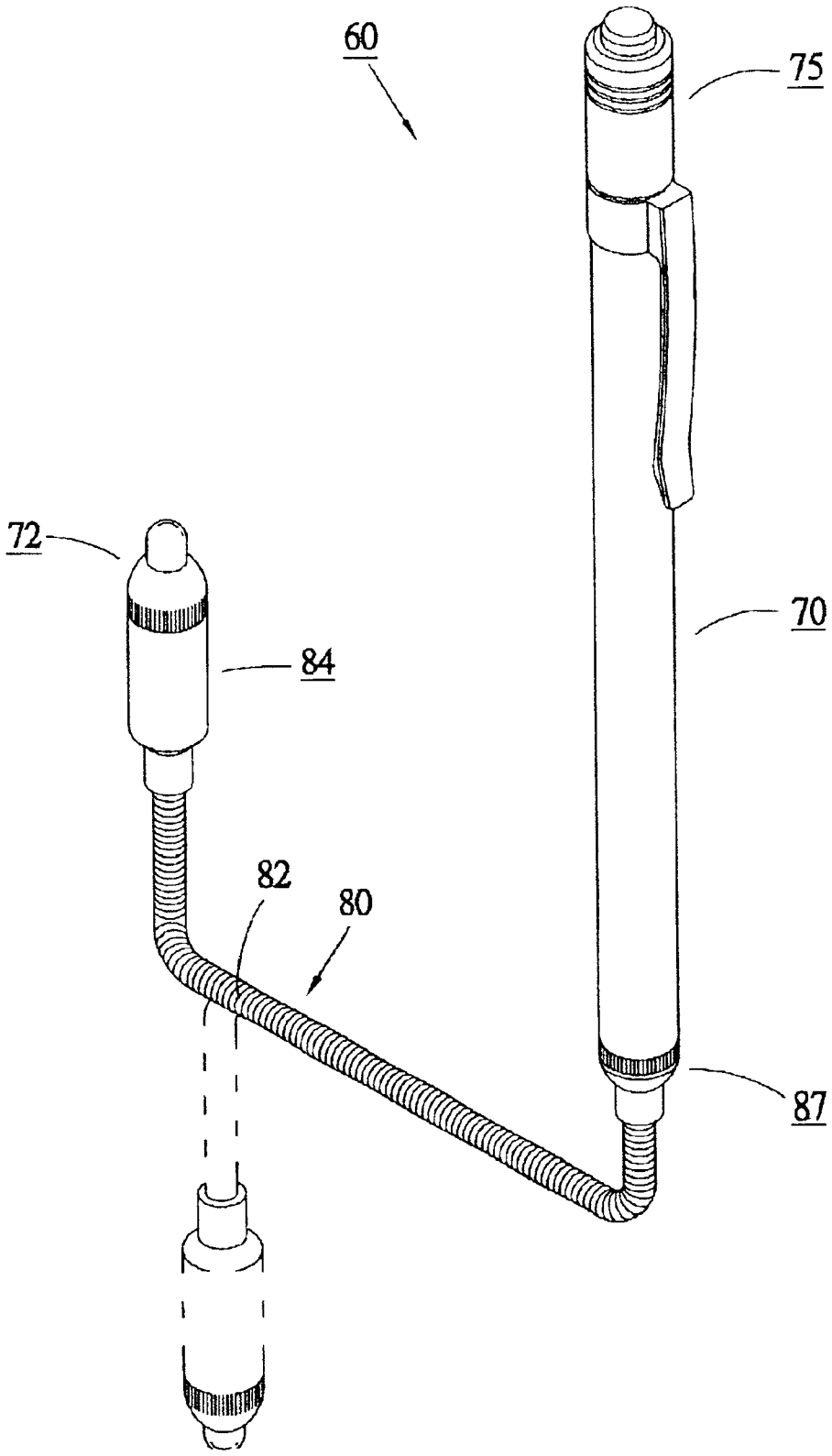
FIG. 6 is a perspective assembled view of the first embodiment of the present invention.

FIGS. 5 and 6 show another embodiment of the present invention, in which the flashlight 60 includes a barrel body 70, a predetermined number of LED lights 72, a switch seat 75 and a conductive connecting assembly 80. The barrel body, LED lights and switch seat are identical to those of the above embodiment and will not be further described hereafter.

The conductive connecting assembly 80 includes an elongated freely flexible member 82. The flexible member 82 serves to provide electrical conduction effect. The flexible member 82 can be made of conductive material. Alternatively, the flexible member 82 can have inner and outer layers. The outer layer is made of insulating material, while the inner layer is conductive. The conductive connecting assembly 80 further includes a connector 84 which is a hollow cylindrical member. One end of the connector 84 is fixedly connected with one end of the flexible member 82. A contact 85 is disposed in the connector and electrically connected with the flexible member 82. A threaded section 86 is formed on inner circumference of free end of the connector 84. The conductive connecting assembly 80 further includes a conductive connecting member 87 one end of which is fixedly connected with the other end of the flexible member 82. A threaded section 88 is formed on outer circumference of the other end of the conductive connecting member 87. A contact 89 is disposed at free end of the conductive connecting member 87 and electrically connected with the flexible member 82.

When installed, the conductive connecting member 87 of the conductive connecting assembly 80 is screwed into front end of the barrel body 70 to make the contact 89 contact with the positive electrode of the cell. A light 72 is screwed into the connector 84 to make the conductive section of the light contact with the contact 85 in the connector. Accordingly, the barrel body, conductive connecting assembly 80 and the light 72 are electrically connected. By means of operating the switch seat 75, the flashlight can be turned on or off.

When illuminated, a user can flex the flexible member 82 in accordance with the condition of the using site shown by solid line and phantom line. Therefore, the flashlight can be used to illuminate a dead corner in narrow space or a fissure.

Similarly, different lights can be mounted on the connector 84 of the conductive connecting assembly to change the color of light beam.

Moreover, the conductive connecting assembly 80 can be detached from the barrel body to form a state as shown in FIG. 3.

According to the above arrangement, the present invention has the following advantages:

1 The LED of the present invention is replaceable. Therefore, when the using life of the LED ends or in case the LED is damaged, the LED light can be replaced with a new one without discarding the barrel body and the switch seat.

2 Different colors of LED can be selectively used as necessary. For example, a white light LED can be selected to achieve better illumination. A violet LED can be selected to identify a note. Therefore, the application range of the flashlight of the present invention is widened.

3 When used in state as shown in FIG. 5, the light source can be extended into a narrow space such as an engine room, dead corner or fissure to illuminate the same.

The above embodiments are only used to illustrate the present invention, not intended to limit the scope thereof.

What is claimed is:

1. LED flashlight with replaceable LED, comprising:

a barrel body having an internal receiving space passing through rear end of the barrel body for installing cells therein;

an LED being mounted at front end of the barrel body and electrically connected with the cells in the barrel body; and a switch seat disposed at rear end of the barrel body for electrically connecting with the cells therein, whereby by means of operating the switch seat, the opening/closing of the circuit of the flashlight can be controlled so as to turn on/off the LED, said flashlight being characterized in that:

the receiving space also passes through front end of the barrel body; a screwed section being formed on inner circumference of front end of the receiving space; the flashlight further comprising:

at least one LED light including:

a light seat, an outer circumference of rear end of the light seat being formed with a threaded section, a conductive section being disposed on rear end face of the light seat; and an LED disposed at front end of the light seat and electrically connected with the conductive section;

the threaded section of the light seat being detachably connected with the screwed section of the barrel body, the conductive section being disposed in the receiving space and electrically connected with the cells, whereby in case the LED cannot be further used, the light can be taken off from the barrel body and replaced with a new one.

2. LED flashlight as claimed in claim 1, wherein the flashlight includes at least two LED lights, the LED of the LED lights emitting light beams with different colors.

3. LED flashlight as claimed in claim 1, wherein the flashlight includes at least two LED lights, the LED of the LED lights emitting light beams with the same color.

4. LED flashlight as claimed in claim 1, wherein a boss section is disposed at rear end of the light seat, the conductive section being disposed on rear end face of the boss section.

5. LED flashlight as claimed in claim 3, wherein a boss section is disposed at rear end of the light seat, the conductive section being disposed on rear end face of the boss section.

6. LED flashlight as claimed in claim 2, wherein a boss section is disposed at rear end of the light seat, the conductive section being disposed on rear end face of the boss section, the color of the boss section being just the color of the light beam emitted by the LED.

7. LED flashlight as claimed in claim 4, wherein the boss section is made of nonconductive material, the conductive section being formed by a metal wire embedded in the boss section, an inner end of the metal wire being electrically connected with the LED and an outer end of the metal wire is exposed to outer side of the boss section.

8. LED flashlight as claimed in claim 6, wherein the boss section is made of nonconductive material, the conductive section being formed by a metal wire embedded in the boss section, an inner end of the metal wire being electrically connected with the LED and an outer end of the metal wire is exposed to outer side of the boss section.

9. LED flashlight as claimed in claim 1, wherein the screwed section and the threaded section are threads.

10. LED flashlight as claimed in claim 1, wherein a clip member is disposed on outer circumference of the barrel body.

11. LED flashlight with replaceable LED, comprising:

a barrel body having an internal receiving space passing through rear end of the barrel body for installing cells therein;

an LED being mounted at front end of the barrel body and electrically connected with the cells in the barrel body; and a switch seat disposed at rear end of the barrel body for electrically connecting with the cells therein, whereby by means of operating the switch seat, the opening/closing of the circuit of the flashlight can be controlled so as to turn on/off the LED, said flashlight being characterized in that:

the receiving space also passes through front end of the barrel body; a screwed section being formed is inner circumference of front end of the receiving space, the flashlight further comprising:

a conductive connecting assembly including:

an elongated flexible member for providing electrical conduction effect;

a connector which is a hollow cylindrical member, one end of the connector being fixedly connected with one end of the flexible member; a contact disposed in the connector and electrically connected with the flexible member, a threaded section being formed on inner circumference of free end of the connector; and a conductive connecting member, one end of which is fixedly connected with the other end of the flexible member, a threaded section being formed on outer circumference of the other end of the conductive connecting member, a contact being disposed on free end of the conductive connecting member and electrically connected with the flexible member, the threaded section of the conductive connecting member being detachably connected with the screwed section of the barrel body, the contact of the conductive connecting member being electrically connected with the cells within the barrel body;

at least one LED light including:

a light seat, an outer circumference of rear end of the light seat being formed with a threaded section, a conductive section being disposed on rear end face of the light seat; and an LED disposed at front end of the light seat and electrically connected with the conductive section of the light seat;

the threaded section of the light seat being detachably connected with the threaded section of the connector, the conductive section being electrically connected with the contact of the connector, whereby the LED light of the flashlight is replaceable and the flashlight can be used in a narrow space.

12. LED flashlight as claimed in claim 11, wherein the flashlight includes at least two LED lights, the LED of the LED lights emitting light beams with different colors.

13. LED flashlight as claimed in claim 11, wherein the flashlight includes at least two LED lights, the LED of the LED lights emitting light beams with the same color.

14. LED flashlight as claimed in claim 11, wherein a boss section is disposed at rear end of the light seat, the conductive section being disposed on rear end face of the boss section.

15. LED flashlight as claimed in claim 13, wherein a boss section is disposed at rear end of the light seat, the conductive section being disposed on rear end face of the boss section.

16. LED flashlight as claimed in claim 12, wherein a boss section is disposed at rear end of the light seat, the conductive section being disposed on rear end face of the boss section, the color of the boss section being just the color of the light beam emitted by the LED.

17. LED flashlight as claimed in claim 14, wherein the boss section is made of nonconductive material, the conductive section being formed by a metal wire embedded in the boss section, an inner end of the metal wire being electrically connected with the LED and an outer end of the metal wire is exposed to outer side of the boss section.

18. LED flashlight as claimed in claim 16, wherein the boss section is made of nonconductive material, the conductive section being formed by a metal wire embedded in the boss section, an inner end of the metal wire being electrically connected with the LED and an outer end of the metal wire is exposed to outer side of the boss section.

19. LED flashlight as claimed in claim 11, wherein the screwed section and the threaded sections of the LED light, connector and conductive connecting member are threads.

20. LED flashlight as claimed in claim 11, wherein a clip member is disposed on outer circumference of the barrel body.

* * * * *